US009567705B2

(12) United States Patent
Chua et al.

(10) Patent No.: US 9,567,705 B2
(45) Date of Patent: Feb. 14, 2017

(54) HAND-HELD STEAMER HEAD

(71) Applicant: KONINKLIJKE PHILIPS N.V., Eindhoven (NL)

(72) Inventors: Hee Keng Chua, Eindhoven (NL); Luck Wee Png, Eindhoven (NL); Mahesh Gurumalliah Areyur, Eindhoven (NL); Slew Hon Loke, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/780,607

(22) PCT Filed: Apr. 15, 2014

(86) PCT No.: PCT/IB2014/060719
§ 371 (c)(1),
(2) Date: Sep. 28, 2015

(87) PCT Pub. No.: WO2014/177964
PCT Pub. Date: Nov. 6, 2014

(65) Prior Publication Data

US 2016/0053430 A1 Feb. 25, 2016

(30) Foreign Application Priority Data

Apr. 30, 2013 (EP) ..... 13165878

(51) Int. Cl.
*D06F 87/00* (2006.01)
*D06F 75/30* (2006.01)
*D06F 75/38* (2006.01)

(52) U.S. Cl.
CPC ..... *D06F 87/00* (2013.01); *D06F 75/30* (2013.01); *D06F 75/38* (2013.01)

(58) Field of Classification Search
CPC ..... A47L 10/40; D06F 75/08; D06F 75/10; D06F 75/20; D06F 75/30; D06F 75/12; D06F 75/36; D06F 75/38; D06F 87/00; D06F 73/00; F22B 1/28
See application file for complete search history.

(56) References Cited

U.S. PATENT DOCUMENTS 2,065,366 A * 12/1936 Eichorn ..... D06F 75/38 219/254
2,418,511 A * 4/1947 Hume ..... D06F 75/18 137/315.25
2,750,694 A * 6/1956 Spencer ..... D06F 75/14 38/77.4
4,817,309 A 4/1989 Frank
5,010,905 A * 4/1991 Snyder ..... A45D 19/16 132/212

(Continued)

FOREIGN PATENT DOCUMENTS

FR 2709138 A1 2/1995
GB 931250 A 7/1963

(Continued)

*Primary Examiner* — Ismael Izaguirre

(57) ABSTRACT

The present application relates to a hand-held steamer head. The steamer head (21) comprises a handle (3) and a soleplate (2) through which steam is ejected onto a surface being steamed. The soleplate is flexibly coupled to the handle or the soleplate is pivotally coupled to the handle and is biased in a direction away from the handle by a biasing member.

20 Claims, 5 Drawing Sheets

(56) References Cited

U.S. PATENT DOCUMENTS

| | | | | | |
|---|---|---|---|---|---|
| 5,038,501 | A * | 8/1991 | Hipp | D06F 75/22 | 38/77.5 |
| 5,420,961 | A * | 5/1995 | Walker | A45D 44/00 | 392/403 |
| 5,609,047 | A * | 3/1997 | Hellman, Jr. | D06F 73/00 | 239/538 |
| 5,721,418 | A | 2/1998 | Hazan | | |
| 8,522,463 | B2 | 9/2013 | Ong | | |
| 2008/0283080 | A1 | 11/2008 | Habibi | | |
| 2010/0058623 | A1 * | 3/2010 | Fernandez | D06F 71/18 | 38/14 |
| 2010/0088932 | A1 * | 4/2010 | Rosenzweig | D06F 75/20 | 38/77.8 |

FOREIGN PATENT DOCUMENTS

| | | | |
|---|---|---|---|
| GB | 2438619 | A | 12/2007 |
| WO | 2004002262 | A1 | 1/2004 |
| WO | WO2010086755 | A1 * | 8/2010 |
| WO | 2012066473 | A2 | 5/2012 |
| WO | 2014167365 | A1 | 10/2014 |

* cited by examiner

HAND-HELD STEAMER HEAD

This application is the U.S. National Phase application under 35 U.S.C. §371 of International Application No. PCT/IB2014/060719, filed on Apr. 15, 2014, which claims the benefit of European Application No. 13165878.3 filed on Apr. 30, 2013. These applications are hereby incorporated by reference herein.

FIELD OF THE INVENTION

The present invention relates to a hand-held steamer for a garment steamer and to a steamer comprising the steamer head of the invention.

BACKGROUND OF THE INVENTION

Garment steamers are known for steaming garments to remove creases from a fabric material of a garment through the use of heat and moisture. Such a garment steamer generally comprises a steam generating unit and a steamer head connected to the steam generating unit by a flexible hose through which steam is conveyed to the steamer head. The steamer head is provided with one or more steam holes to discharge steam onto the fabric being treated. Typically, the garment is hung on a hanger during treatment by the steamer and the user positions the steamer head over the garment to remove creases. Such a steamer head is disclosed in WO 2012/066473 and comprises a soleplate and a handle. The user grips the handle to position the soleplate over the section of fabric to be treated.

SUMMARY OF THE INVENTION

According to the present invention, there is provided a hand-held steamer head comprising a handle and a soleplate through which steam is ejected onto a surface being steamed, wherein the soleplate is flexibly coupled to the handle by a flexible bellows or the soleplate is pivotally coupled to the handle and is biased in a direction away from the handle by a biasing member.

In one embodiment, the soleplate has an outer surface and the soleplate is pivotal relative to the handle between a first position and a second position, wherein the angle between the handle and the outer surface is greater in the first position than in the second position, and wherein the biasing member biases the soleplate towards the first position. Such a pivotally coupled soleplate can remain in close contact to the garment when the position of the handle is changed relative to the fabric and therefore can prevent loss of steam which is detrimental to the performance of the steamer head and can result in uneven application of steam at different points on the fabric. The hand-held steamer may include means to restrict the range of movement of the soleplate relative to the handle between the first and second positions. This may reduce strain on other components of the device, such as any of the steam supply conduits.

In one embodiment, the soleplate is pivotal relative to the handle about a pivotal axis and, the soleplate comprises a central axis parallel to the pivotal axis, wherein the distance between the soleplate central axis and the handle changes as the soleplate pivots relative to the handle. The soleplate may comprise an outer surface. A majority of the outer surface may move away from the handle under the force of the biasing member. These embodiments may result in an increased range of pivotal movement between the handle and soleplate.

In one embodiment, the soleplate comprises an edge that is pivotally connected to the handle and is distal to a free edge of the soleplate that is urged away from the handle by the biasing member. This means that the free edge of the soleplate can move towards the handle as the steamer head is moved on the surface of the fabric during use to stay flush to the fabric.

In one embodiment a steam conduit is disposed in the handle and the flexible bellows fluidly communicates the steam conduit with one or more steam holes in the soleplate. Such a flexible bellow allows more degree of freedom as compared to a pivotal coupling, and allows less flow resistance for the steam to reach the steam holes.

In one embodiment, the soleplate is flexibly coupled to the handle by the flexible bellows and the soleplate is pivotally connected to the handle and is biased away from the handle by the biasing member. The flexible bellows allows for rotational movement of the soleplate relative to the handle whilst still fluidly communicating the steam holes with the handle. In such an embodiment, the flexible bellows may comprise a pleated peripheral wall that may be compressed to allow for relative movement of the soleplate and handle. The flexible bellows may comprise the biasing member. The flexible bellows may comprise a non-permeable material.

In one position the soleplate may sit flush to the handle. This may limit the degree of rotation of the soleplate.

The steamer head may comprise a housing that receives the soleplate, wherein the handle is pivotally connected to the housing. In one embodiment, a steam conduit is disposed in the housing and is spaced from the handle. This allows for rotational movement of the soleplate relative to the handle whilst the steam conduit is still fluidly communicated with the steam holes in the soleplate.

In one embodiment, the soleplate comprises two opposing edges and is pivotally connected to the handle at a point between the opposing edges. This means that one of the opposing edges of the soleplate can move towards the handle and the other opposing edge away from the handle as the steamer head is moved down the fabric during use so that the soleplate stays flush to the fabric.

In one embodiment, the housing comprises a first stopper element and the handle comprises a second stopper element, and the first and second stopper elements are configured to engage to limit the maximum rotational displacement of the soleplate relative to the handle. This means that the maximum angular displacement of the handle relative to the soleplate can be limited.

In one embodiment the biasing member may comprise a hinged spring. In an alternate embodiment, the biasing member comprises a deadweight that is connected to the soleplate. The deadweight may be arranged so that when the soleplate is positioned away from the handle the deadweight lies underneath the soleplate at a resting point.

In one embodiment, the soleplate has a soleplate axis that extends perpendicularly to the surface of the soleplate and a flexible hose extends from the housing and has a longitudinal axis that is at an angle of between 80 degrees and 135 degrees to the soleplate axis.

In one embodiment, the longitudinal axis of the portion of the flexible hose that extends from the housing intersects the rotational axis of the rotatable connection between the handle and the housing. In an alternate embodiment, the rotational axis of the rotatable connection between the handle and the housing is disposed between the soleplate and the longitudinal axis of the flexible hose.

In one embodiment, the hand-held steamer head comprises a suction generator having an air inlet through which air is sucked to urge the surface being steamed towards the soleplate.

In one embodiment, the hand-held steamer head comprises a steam generator. The steam generator may be disposed in the handle or housing of the steamer head.

According to another aspect, there is also provided a garment steamer comprising the steamer head according to the invention.

An iron is disclosed in GB 2438619 and comprises a flat plate that is pivotally connected to a handle. However, the plate is biased into a central position relative to the handle and the configuration is such that the iron is not suitable for treating hanging garments and instead is for treating fabrics that have been placed on a hard flat surface.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
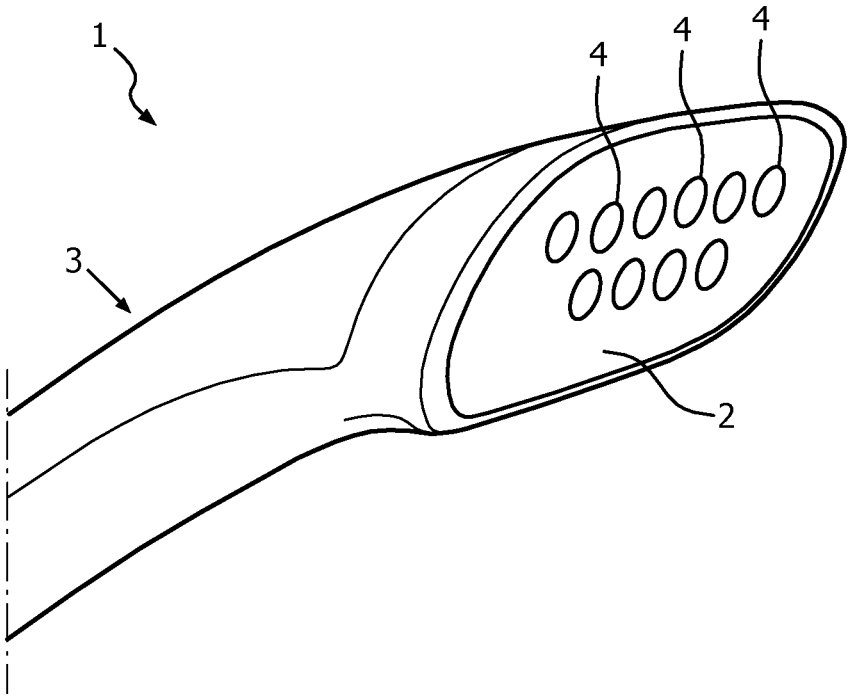
FIG. 1 shows a perspective view of a known steamer head, for background information.

Referring now to FIG. 1, a known hand-held steamer head 1 is shown, for background information only. The steamer head 1 comprises a soleplate 2 and a handle 3. A flexible hose (not shown) of a garment steamer is disposed in the handle 3 and fluidly communicates a steam generating means (not shown) with steam holes 4 in the soleplate 2.

Figure 2:
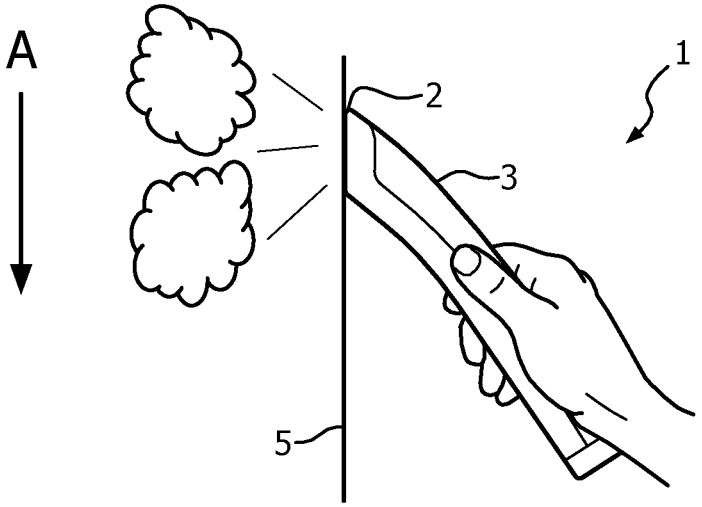
FIG. 2 shows a side view of the steamer head of FIG. 1, in a first position.

As can be seen from FIG. 2, the soleplate 2 forms a flat surface that, in use, sits flush with and passes over a surface to be steam treated, such as the fabric 5 of a garment. To remove creases from the fabric 5 the user hangs the fabric 5 from a garment hanger (not shown) and locates the steamer head 1 against the fabric 5.

Once the steamer head 1 is positioned against the fabric 5, steam generated by the steam generation means flows out of the plurality of steam holes 4 towards the fabric disposed proximate thereto. The steam is forced through the fabric 5 or condenses thereon to remove creases in the fabric 5.

Figure 3:
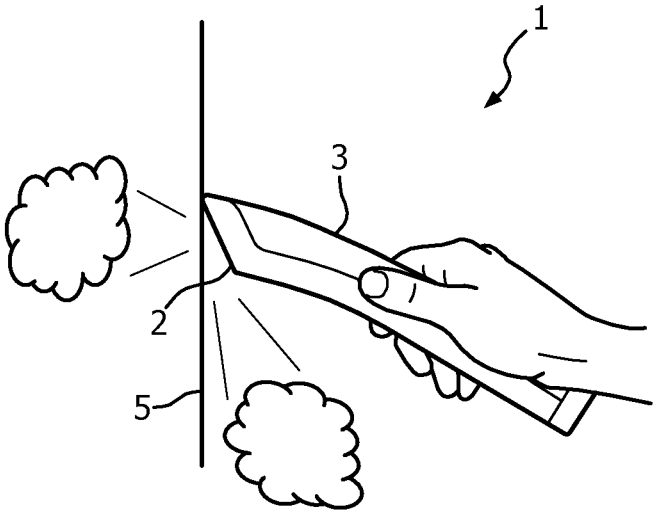
FIG. 3 shows a side view of the steamer head of FIG. 1, in a second position.

The user then draws the steamer head 1 along the fabric 5 in a downwards motion (as shown by arrow 'A' in FIG. 2). The user's arm moves in an arcuate motion and so the angle that the user's arm and the handle 3 extends relative to the fabric changes as the steamer head 1 is moved down the fabric 5. Therefore, the angle of the soleplate 2 relative to the fabric 5 will also change so that the soleplate 2 may no longer sit flush to the fabric 5, as shown in FIG. 3. This can result in a gap forming between the surface of the soleplate 2 and the fabric 5, allowing steam to escape. It has been found that steam loss can be detrimental the performance of the steamer. Additionally, as the steamer performance varies depending on the position of the steamer head 1 on the fabric, the level of crease removal at the top and bottom of the fabric 5 may be inconsistent. Furthermore, leaked steam may burn the user if it is deflected towards the handle 3.

Figure 4:
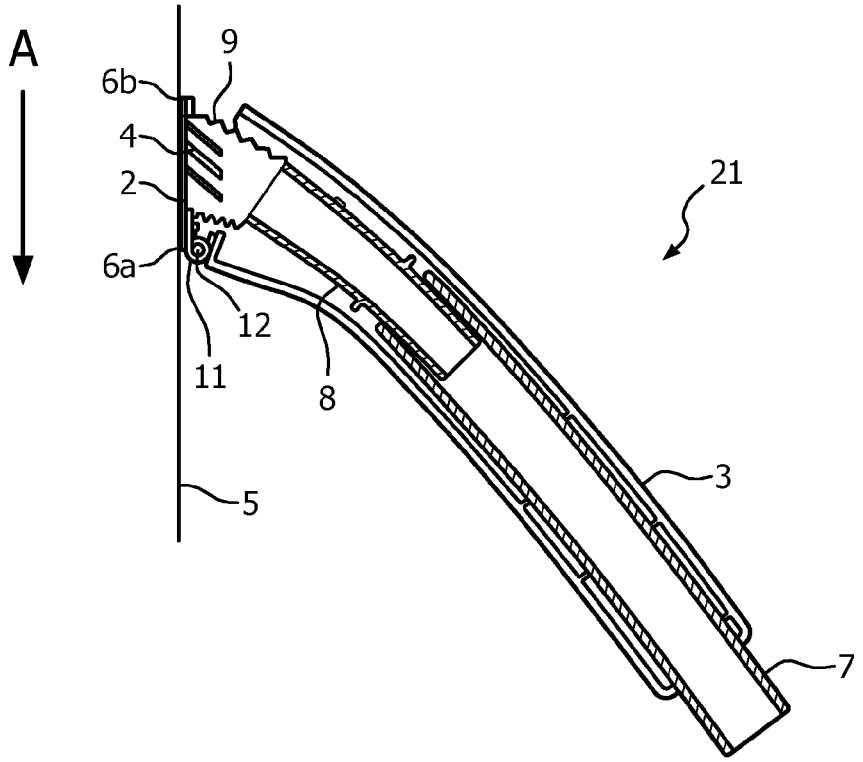
FIG. 4 shows a cross-sectional view of a steamer head according to a first embodiment of the invention, in a first position.
Figure 5:
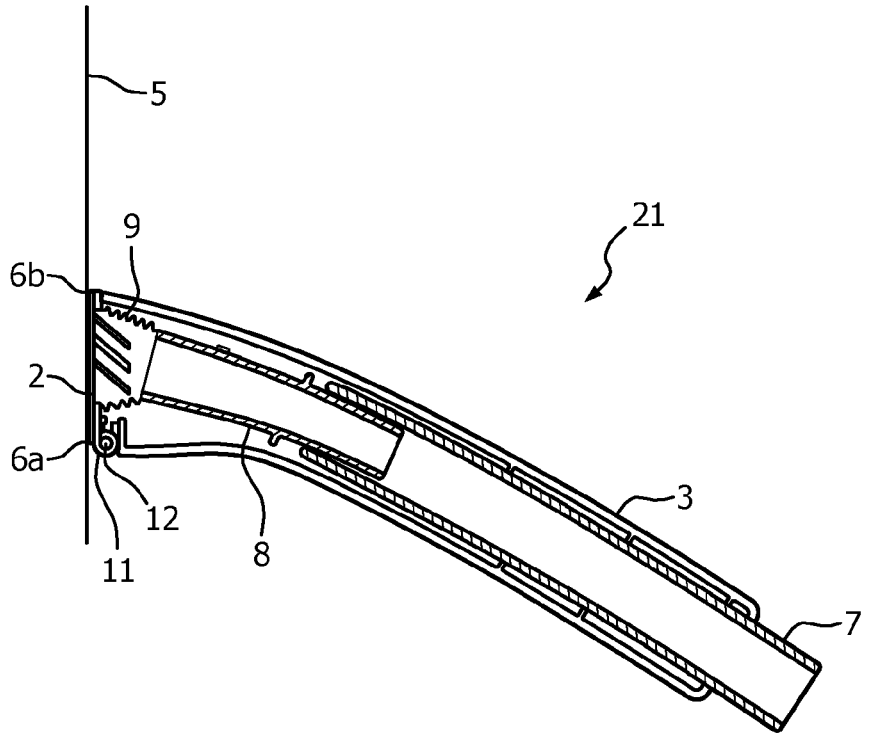
FIG. 5 shows a cross-sectional view of the steamer head of FIG. 4, in a second position.

Referring now to FIGS. 4 and 5, a hand-held steamer head 21 of a first embodiment of the present invention is shown. The steamer head 21 comprises a soleplate 2 that is rotatably connected to a handle 3.

A funnel shaped nozzle 8 is disposed in the handle 3 and is fluidly communicated with the flexible hose 7 to form a steam conduit. The steam conduit is fluidly connected to a steam generating means of a garment steamer (not shown).

The soleplate 2 comprises a plurality of steam holes 4 that are fluidly communicated with the funnel shaped nozzle 8 by a flexible bellows 9. An end surface of a peripheral wall of the flexible bellows is sealed to the soleplate 2 so that steam is guided into the flexible bellows 9 by the nozzle 8 and then flows out of a plurality of steam holes 4 in the soleplate 2.

A hinge 11 pivotally connects an end of the handle 3 to a first edge **6*a* of the soleplate 2. A hinged spring 12 biases the soleplate 2 away from the handle 3 so that a free edge 6*b* of the soleplate, opposing the first edge 6*a*, is spaced from the handle 3. The handle 3 is rotatable relative to the soleplate 2 by applying a force to the handle 3 when the soleplate 2 is constrained against a surface. During the rotational movement of the soleplate 2 relative to the handle 3, the flexible bellows 9 are compressed between the nozzle 8 and the soleplate 2 to allow for rotation of the soleplate 2 whilst maintaining a fluid connection between the nozzle 8 and the steam holes 4 of the soleplate 2. The flexible bellows 9** comprises a non-permeable material, for example, rubber, plastic, fabric or a combination thereof.

To remove creases from the fabric 5 of a garment, the user hangs the garment from a garment hanger (not shown), such that the fabric 5 of the garment hangs from the garment hanger in a vertical orientation and locates the steamer head 21 against the fabric 5. However, it will be appreciated that the garment may be arranged and supported in other orientations. In operation, the soleplate 2 is positioned against the fabric 5 and steam is supplied to the nozzle 8, via the flexible hose 7, and then passes into the flexible bellows 9 and out of the plurality of steam holes 4 towards the fabric disposed proximate thereto.

The user then draws the steamer head 21 along the fabric 5 in a downwards motion (as shown by arrow 'A' in FIGS. 4 and 5). As described previously, the angle that the user's arm extends relative to the fabric changes as the steamer head 21 is moved down the fabric. To compensate for this, the handle 3 pivots relative to the soleplate 2 so that the angle between the soleplate 2 and the handle 3 (e.g. the main axis of the handle, or the plane of the end face of the handle, or an end portion of the handle) changes and so the soleplate 2 remains flush to the fabric 5. This flush fit to the fabric 5 prevents a gap from forming between the fabric 5 and the soleplate 2 and therefore steam loss is prevented.

As the user continues to draw the steamer head 21 along the fabric 5 in a downwards motion, the soleplate 2 will continue to rotate relative to the handle so that the free edge **6*b* of the soleplate 2 moves towards the handle, against the force of the hinged spring 12, until the soleplate 2 sits flush to an end surface of a peripheral wall of the handle 3, as shown in FIG. 5**.

When the user repositions the steamer head 21 back to the top of the fabric to remove creases from a new section thereof, the hinged spring 12 will urge the soleplate 2 back away from the handle 3 so that the soleplate 2 continues to sit flush to the fabric 5.

Although in the above described embodiments the steamer head 21 comprises a hinged spring 12, in an alternate embodiment (not shown) the hinged spring 12 may be replaced by another suitable biasing member, for example, a coil spring, a lever spring or a portion of elastic or elastomeric material positioned between the soleplate 2 and the handle 3. In yet another embodiment (not shown), the biasing member comprises a deadweight that is connected to the soleplate and is arranged so that when the soleplate 2 is rotated away from the handle 3 the deadweight is positioned at its resting point which lies underneath where the soleplate 2 is rotatably connected to the handle 3. In such an embodiment, if the soleplate 2 is rotated towards the handle 3 the deadweight will swing away and upwardly from its resting point and the effect of gravity on the deadweight will result in the deadweight being urged back towards its resting position so that the soleplate 2 is urged away from the handle 3.

Although in the above described embodiments the steamer head 21 comprises a separate flexible bellows 9 and biasing member, in an alternate embodiment (not shown) the flexible bellows may comprise the biasing member. For example, the flexible bellows may be constructed by pleating a flexible material so that the pleats provide a biasing force when compressed. In yet another embodiment, the flexible bellows may be manufactured from an elastically deformable frame covered in a flexible material.

Although in the above described embodiment the hinged spring 12 is connected to an the edge 6*a* of the soleplate 2 that, in use, is proximate the ground, in an alternate embodiment (not shown) the hinged spring 12 may be connected to an edge of the soleplate that, in use, is remote to the ground, with the free edge of the soleplate being provided proximate to the ground. Such an embodiment may be useful if the steamer head is used by positioning the steamer head at the bottom of the fabric and moved in an upwards motion.

Figure 6:
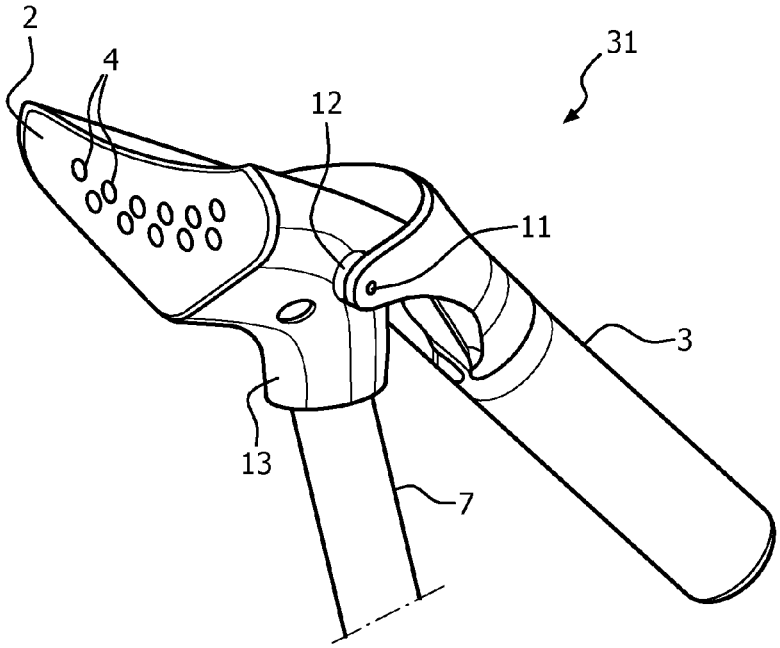
FIG. 6 shows a perspective view of a steamer head according to a second embodiment of the invention.
Figure 7:
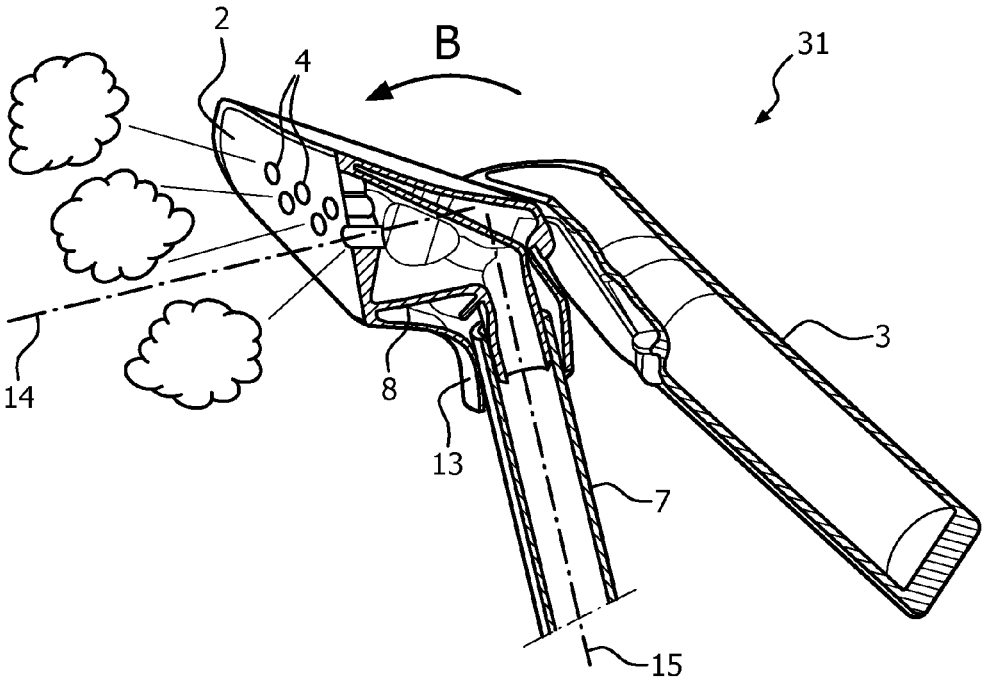
FIG. 7 shows a cross-sectional perspective view of the steamer head of FIG. 6; and, FIG. 8 shows a cross-sectional view of a steamer head according to a third embodiment of the invention.

Referring now to FIGS. 6 and 7, a steamer head 31 according to a second embodiment of the invention is shown. The steamer head 31 comprises a housing 13 that receives a soleplate 2. The housing 13 is rotatably connected to a handle 3 so that the handle 3 and housing 13 are pivotable about a rotational axis. A funnel shaped nozzle 8 is disposed in the housing 13 and is fluidly communicated with a flexible hose 7 to form a steam conduit. The soleplate 2 has a soleplate axis 14 that extends perpendicularly to the outer surface of the soleplate 2. The soleplate axis 14 extends away from the longitudinal axis of the handle 3 at an angle and is rotatable relative thereto. The portion of the flexible hose 7 that extends from the housing 13 has a longitudinal axis 15 that is perpendicular to the soleplate axis 14. The longitudinal axis 15 of said portion of flexible hose 7 intersects the rotational axis of the rotatable connection between the handle 3 and the housing 13. The steam conduit is fluidly connected to a steam generating means of a garment steamer (not shown). A plurality of steam holes 4 are provided in the soleplate 2 and are fluidly communicated with the nozzle 8. Unlike the first embodiment of the invention, the steam conduit is not disposed in the handle 3. Therefore, during use, steam does not travel through the handle 3 and so the handle 3 is prevented from heating up, preventing discomfort to the user.

A hinge 11 pivotally connects an end of the handle 3 to the housing 13 so that the soleplate 2 is rotatable relative to the handle 3. A pair of hinged springs 12 bias the housing 13 so that the outer surface of the soleplate 2 is urged away from the handle 3 (in the direction shown by Arrow 'B' in FIG. 7) and is urged into a position wherein the angle that the soleplate axis 14 extends away from the longitudinal axis of the handle 3 is increased. The handle 3 is rotatable relative to the housing 13 and soleplate 2 by applying a force to the handle 3 when the soleplate is 2 constrained against a surface. The degree of rotation is restricted by a pair of stoppers (not shown) that are positioned between the housing 13 and handle 3 that engage when a certain rotational displacement of the soleplate is reached. In one embodiment, the stoppers engage when the outer surface of the soleplate is perpendicular to the longitudinal axis of the handle 3.

As described in the above embodiment, to remove creases from the fabric of a garment, the user hangs the garment from a garment hanger, such that the fabric of the garment hangs from the garment hanger in a vertical orientation and locates the steamer head 31 against the fabric. When the steamer head 31 is located against the fabric the soleplate 2 sits flush against the fabric so that steam is supplied to the funnel 8 via the flexible hose 7. Steam flows through the funnel 8 and out of the plurality of steam holes 4 towards the fabric disposed proximate thereto. The user may then draw the steamer head 31 along the fabric in a downwards motion. As the angle of the user's arm changes relative to the fabric, the handle 3 pivots relative to the housing 13 so that the soleplate 2 remains flush to the fabric to prevent any gaps from forming there between to prevent steam loss.

When the user repositions the steamer head 31 to the top of the fabric to remove creases from a new section thereof, the hinged springs 12 will urge the soleplate 2 away from the handle 3 so that the soleplate 2 continues to sit flush to the fabric.

Although in the above described embodiment the longitudinal axis 15 of the portion of the flexible hose 7 that extends from the housing 13 is perpendicular to the soleplate axis 14, in alternate embodiments (not shown) the longitudinal axis 15 may be at an oblique angle to the soleplate axis 14. For example, the longitudinal axis 15 may be at an angle of 80 degrees to the soleplate axis 14, so that when the soleplate is positioned against the surface to be steamed the flexible hose extends out of the housing and towards said surface, or at an angle of 135 degrees to the soleplate axis, so that when the soleplate is positioned against the surface to be steamed the flexible hose extends out of the housing and away from said surface.

Although in the above described embodiment the longitudinal axis 15 of the portion of the flexible hose 7 that extends from the housing 13 intersects the rotational axis of the rotatable connection between the handle 3 and the housing 13, in an alternate embodiment (not shown) the rotational axis of the rotatable connection between the handle and the housing is disposed between the soleplate and the longitudinal axis of the flexible hose.

Although in the above described embodiment the steamer head 31 comprises a pair of hinged springs 12, in an alternate embodiment the steamer head may only comprise one hinged spring. Additionally, although in the above described embodiments the steamer head comprises a hinge and a separate hinged spring, in an alternate embodiment (not shown) the hinge may comprise the hinged spring so that the pivotal connection is provided by the hinged spring. Furthermore, the hinged spring or springs 12 may be replaced by another suitable biasing member, for example, a coil spring, a lever spring or a portion of elastic or elastomeric material positioned between the handle 3 and the housing 13. In yet another embodiment (not shown), the biasing member comprises a deadweight that is connected to the housing 13 and is arranged so that when the soleplate 2 is rotated away from the handle 3 the deadweight is positioned at its resting point which lies underneath where the handle 3 is rotatably connected to the housing 13. In such an embodiment, if the soleplate 2 is rotated towards the handle 3 the deadweight will swing away and upwardly from its resting point and the effect of gravity on the deadweight will result in the deadweight being urged back towards its resting position so that the soleplate 2 is urged away from the handle 3.

In the above described embodiment the soleplate 2 is connected to the housing 13 using an adhesive. However, in an alternate embodiment (not shown), the soleplate may be integrally formed with the housing.

Although in the above described embodiment the nozzle 8 is a separate component to the housing 13 and is disposed therein, in an alternate embodiment (not shown) the nozzle is formed from the walls of the housing.

Figure 8:
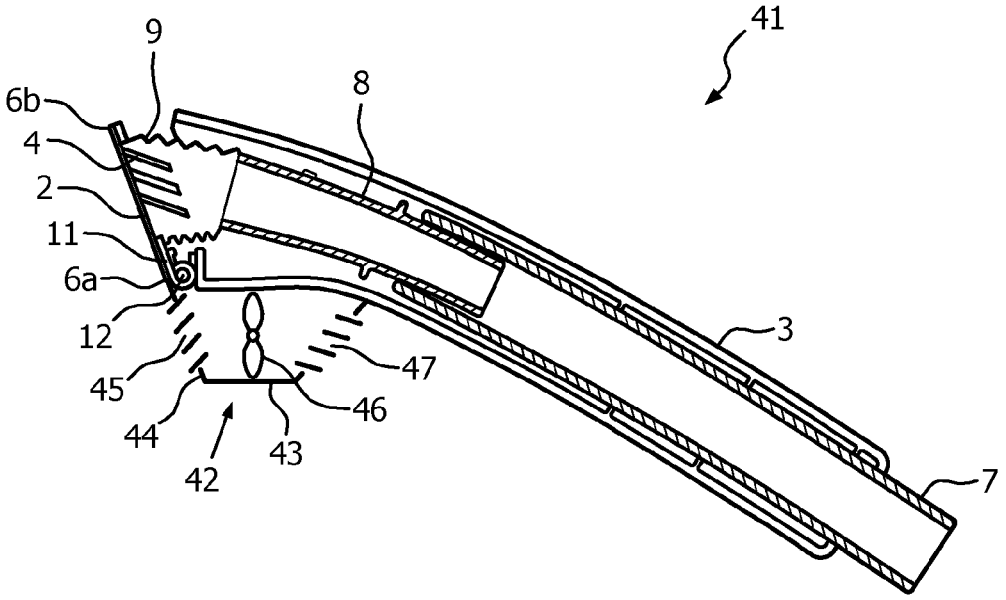

Referring now to FIG. 8, a steamer head 41 according to a third embodiment of the invention is shown and is similar to the first embodiment of the invention, with like features retaining the same reference numerals. A difference between the first and third embodiments is that the steamer head 41 of the third embodiment further comprises a suction means 42. The suction means 42 comprises a fan housing 43 that is disposed on the side of the handle 3. The fan housing 43 comprises a front surface 44 that faces towards the fabric when the soleplate 2 is placed against the fabric to be steamed and a plurality of apertures are provided in the front surface 44 and form an air inlet 45. The air inlet 45 is fluidly communicated with a suction generator 46, for example, a fan, which is disposed inside the fan housing 43. The suction generator 46 is configured to draw air into the fan housing 43 through the air inlet 45 and then expel the air through a plurality of apertures that form an air outlet 47 which is provided in a surface of the fan housing 43 that is downstream of the suction generator 46.

To remove creases from the fabric of a garment, the user hangs the garment from a garment hanger (not shown), such that the fabric of the garment hangs from the garment hanger in a vertical orientation and locates the steamer head 41 against the fabric. However, it will be appreciated that the garment may be arranged and supported in other orientations. In operation, the soleplate 2 is positioned against the fabric. As with the first embodiment of the invention, steam is supplied to the nozzle 8, via the flexible hose 7, and then passes into the flexible bellows 9 and out of the plurality of steam holes 4 towards the fabric disposed proximate thereto. The suction generator 46 is operated to create a flow of air in the fan housing 43, such that air is sucked in through the air inlet 45, drawn through the fan housing 43 and exhausted through the air outlet 47. Therefore, a low pressure is created at the air inlet 45 and the fabric of the garment is drawn against the front surface 44 of the fan housing 42. As the fabric of the garment is drawn towards the air inlet 45, the fabric is held against the soleplate 2. Steam expressed from the steam holes 4 is therefore expelled directly against the fabric and is forced through the fabric or between the fabric and the soleplate 2. Furthermore, as the air inlet 45 is formed on a different surface to the steam holes 4, the steam is prevented or restricted from being drawn into the air inlet 45 travelling along the fan housing 43 to the air outlet 47. An advantage of this arrangement is that the amount of steam-laden air that passes through the suction generator 46 and is exhausted towards the user is reduced. In addition, as the air outlet 47 is disposed away from the air inlet 45, air is not exhausted back towards the fabric of the garment and does not urge the fabric away from the soleplate 2.

As described previously in relation to the first embodiment of the invention, the user then draws the steamer head 41 along the fabric in a downwards motion so that the soleplate 2 moves down the fabric. The angle that the user's arm extends relative to the fabric changes as the steamer head 41 is moved down the fabric. To compensate for this, the handle 3 pivots relative to the soleplate 2 so that the angle between the soleplate 2 and the handle 3 (e.g. the main axis of the handle, or the plane of the end face of the handle, or an end portion of the handle) reduces and so the soleplate 2 remains flush to the fabric. This flush fit to the fabric prevents a gap from forming between the fabric and the soleplate 2 and therefore steam loss is prevented. As the steamer head 41 is drawn in a downwards motion, with a section of the fabric being drawn against the air inlet 45, the fabric is tensioned between the garment hanger on which the garment is hung and the front surface 44 of the fan housing 43. Therefore, the section of fabric against which the soleplate 2 is positioned is in tension as steam is applied to it, which enhances the ability of the steamer head 41 to remove creases from the fabric of the garment.

As the user continues to draw the steamer head 41 along the fabric in a downwards motion, the soleplate 2 will continue to rotate relative to the handle 3 so that the free edge **6*b* of the soleplate 2 moves towards the handle 3, against the force of the hinged spring 12, until the soleplate 2 sits flush to an end surface of a peripheral wall of the handle 3**.

When the user repositions the steamer head 41 back to the top of the fabric to remove creases from a new section thereof, the hinged spring 12 will urge the soleplate 2 back away from the handle 3 so that the soleplate 2 continues to sit flush to the fabric.

Although in the above described embodiment the air inlet 45 is positioned below the soleplate 2 when the soleplate 2 is positioned against the fabric to be steamed, in an alternate embodiment (not shown) the suction means is configured so that an air inlet is also positioned above the soleplate.

In an alternate embodiment (not shown), the suction means 42 may be provided on a steamer head of the same configuration as the second embodiment of the invention. In such an arrangement, the fan housing is disposed on the housing of the steamer head.

Although in the above described embodiments the nozzle 8 is fluidly communicated with the steam generating unit by a flexible hose 7, in alternate embodiments (not shown) the flexible hose may be omitted and replaced by a rigid conduit. In another embodiment, the nozzle may be directly fluidly connected to the steam generating unit, which may be disposed in the handle and/or housing. In one such embodiment, the flexible hose provides water and/or power for the steam generating unit. In another such embodiment, a water and/or power supply is provided in the handle and/or housing and the flexible hose is omitted.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A hand-held steamer head comprising a handle and a soleplate through which steam is ejected onto a surface being steamed, wherein the soleplate is movable relative to the handle by a flexible bellows, and wherein the soleplate is biased in a direction away from the handle by a biasing member.

2. A hand-held steamer head according to claim 1, wherein the soleplate has an outer surface and wherein the soleplate is pivotal relative to the handle between a first position and a second position, wherein the angle between the handle and the outer surface is greater in the first position than in the second position, and wherein the biasing member biases the soleplate towards the first position.

3. A hand held steamer head according to claim 2, wherein a majority of the outer surface moves away from the handle under the force of the biasing member.

4. A hand-held steamer head according to claim 1, wherein the soleplate is pivotal relative to the handle about a pivotal axis, and the soleplate comprises a central axis parallel to the pivotal axis, wherein the distance between the soleplate central axis and the handle changes as the soleplate pivots relative to the handle.

5. A hand-held steamer head according to claim 1, wherein the soleplate comprises an edge that is pivotally connected to the handle and is distal to a free edge of the soleplate that is urged away from the handle by the biasing member.

6. A hand-held steamer according to claim 1, wherein the flexible bellows comprises the biasing member.

7. A hand-held steamer head according to claim 1, wherein the flexible bellows comprises a pleated peripheral wall that may be compressed to allow for relative movement of the soleplate and handle.

8. A hand-held steamer head according to claim 1, comprising a suction generator having an air inlet through which air is sucked to urge the surface being steamed towards the soleplate.

9. A hand-held steamer head according to claim 1, wherein the biasing member comprises a hinged spring.

10. A hand-held steamer head comprising a handle, a steam conduit, and a soleplate through which steam is ejected onto a surface being steamed, wherein the steam conduit is disposed in the handle, wherein the steam conduit fluidly communicates with one or more steam holes in the soleplate by a flexible bellows, and wherein the soleplate is pivotally connected to the handle and biased in a direction away from the handle by a biasing member.

11. A hand-held steamer head according to claim 10, wherein the soleplate has an outer surface and wherein the soleplate is pivotal relative to the handle between a first position and a second position, wherein the angle between the handle and the outer surface is greater in the first position than in the second position, and wherein the biasing member biases the soleplate towards the first position.

12. A hand held steamer head according to claim 11, wherein a majority of the outer surface moves away from the handle under the force of the biasing member.

13. A hand-held steamer head according to claim 10, wherein the soleplate is pivotal relative to the handle about a pivotal axis, and the soleplate comprises a central axis parallel to the pivotal axis, wherein the distance between the soleplate central axis and the handle changes as the soleplate pivots relative to the handle.

14. A hand-held steamer head according to claim 10, wherein the soleplate comprises an edge that is pivotally connected to the handle and is distal to a free edge of the soleplate that is urged away from the handle by the biasing member.

15. A hand-held steamer according to claim 10, wherein the flexible bellows comprises the biasing member.

16. A hand-held steamer head according to claim 10, wherein the flexible bellows comprises a pleated peripheral wall that may be compressed to allow for relative movement of the soleplate and handle.

17. A hand-held steamer head comprising a handle, a housing and a soleplate through which steam is ejected onto a surface being steamed, wherein the handle is pivotably coupled to the housing, wherein the housing receives the soleplate and is biased away from the handle by a biasing member, and wherein the hand-held steam further comprises a suction generator having an air inlet through which air is sucked to urge the surface being steamed towards the soleplate.

18. A hand-held steamer head according to claim 17, comprising a steam conduit that is disposed in the housing and is spaced from the handle.

19. A hand-held steamer head according to claim 17, wherein the housing comprises a first stopper element and the handle comprises a second stopper element, and the first and second stopper elements are configured to engage to limit the maximum rotational displacement of the soleplate relative to the handle.

20. A hand-held steamer head according to claim 17, wherein the soleplate comprises two opposing edges and the housing is pivotally connected to the soleplate at a point between the opposing edges.

* * * * *